US010954737B1

(12) United States Patent
Nouh et al.

(10) Patent No.: US 10,954,737 B1
(45) Date of Patent: Mar. 23, 2021

(54) SYSTEMS AND METHODS FOR INITIATING AN EMERGENCY DISCONNECT SEQUENCE

(71) Applicant: TRANSOCEAN SEDCO FOREX VENTURES LIMITED, Grand Cayman (KY)

(72) Inventors: Bahaa Nouh, Houston, TX (US); Lasse Eilertsen, Akser (NO); Massimiliano Russo, Houston, TX (US)

(73) Assignees: Kongsberg Maritime Inc., Houston, TX (US); Transocean Sedco Forex Ventures Limited

( * ) Notice: Subject to any disclaimer, the term of this patent is extended or adjusted under 35 U.S.C. 154(b) by 0 days.

(21) Appl. No.: 16/745,670

(22) Filed: Jan. 17, 2020

Related U.S. Application Data

(60) Provisional application No. 62/927,154, filed on Oct. 29, 2019.

(51) Int. Cl.

| | |
|---|---|
| ***E21B 33/035*** | (2006.01) |
| ***E21B 17/01*** | (2006.01) |
| ***E21B 33/064*** | (2006.01) |
| ***E21B 33/038*** | (2006.01) |

(Continued)

(52) U.S. Cl.
CPC ..... *E21B 33/0355* (2013.01); *E21B 17/01* (2013.01); *E21B 19/002* (2013.01); *E21B 33/038* (2013.01); *E21B 33/064* (2013.01); *E21B 47/001* (2020.05)

(58) Field of Classification Search
CPC .. E21B 33/0355; E21B 47/001; E21B 33/038; E21B 33/064; E21B 17/01; E21B 19/002
See application file for complete search history.

(56) References Cited

U.S. PATENT DOCUMENTS 5,978,739 A * 11/1999 Stockton ..... E21B 41/0014 702/6
7,367,396 B2 5/2008 Springett et al.
9,783,199 B2 10/2017 Martin et al.
(Continued)

FOREIGN PATENT DOCUMENTS

EP 2458141 A2 * 5/2012 ..... E21B 33/0355
WO WO-2011147882 A1 * 12/2011 ..... E21B 17/08
(Continued)

*Primary Examiner* — James G Sayre
(74) *Attorney, Agent, or Firm* — Wayne Edward Ramage; Baker Donelson

(57) ABSTRACT

Systems and methods for initiating an emergency disconnect sequence (EDS) are provided. In an aspect, a disconnection system is provided and configured to initiate the EDS, and includes a controller including a processor and a memory operably coupled to the processor. The controller receives, from a set of motion reference units (MRU(s)) operably coupled to a flexible joint, position data generated by the set of motion references units and associated with the joint when the joint is operably coupled to and disposed between a drilling riser and a lower marine riser package (LMRP). The controller determines, based on the position data, an angular offset of the joint. The controller sends, to a subsea control pod disposed at or adjacent to the LMRP, a trigger signal in response to determining that the angular offset exceeds a predetermined threshold, such that the subsea control pod initiates the EDS.

21 Claims, 3 Drawing Sheets

(51) Int. Cl.
*E21B 19/00* (2006.01)
*E21B 47/001* (2012.01)

(56) References Cited

U.S. PATENT DOCUMENTS

| | | | | |
|---|---|---|---|---|
| 2012/0048566 | A1* | 3/2012 | Coppedge | E21B 33/064 166/340 |
| 2012/0132430 | A1 | 5/2012 | Ebenezer | |
| 2013/0220161 | A1 | 8/2013 | Coppedge et al. | |
| 2015/0104328 | A1 | 4/2015 | Babbitt et al. | |
| 2015/0176237 | A1* | 6/2015 | Li | E02B 17/0034 702/34 |
| 2015/0233202 | A1* | 8/2015 | Caldwell | E21B 33/064 166/340 |
| 2016/0312563 | A1 | 10/2016 | Rytlewski et al. | |
| 2018/0202252 | A1 | 7/2018 | Pedersen et al. | |
| 2019/0338614 | A1 | 11/2019 | Angstmann et al. | |

FOREIGN PATENT DOCUMENTS

| | | | | |
|---|---|---|---|---|
| WO | WO 2018/106347 | A1 | 6/2018 | |
| WO | WO-2019158174 | A1 * | 8/2019 | E21B 33/038 |

* cited by examiner

SYSTEMS AND METHODS FOR INITIATING AN EMERGENCY DISCONNECT SEQUENCE

CROSS-REFERENCE TO RELATED APPLICATIONS

This application claims priority to and the benefit of U.S. Provisional Patent Application No. 62/927,154, filed Oct. 29, 2019, entitled "Systems and Methods for Initiating an Emergency Disconnect Sequence," the entire contents of which are incorporated by reference herein for all purposes.

BACKGROUND

The present disclosure relates generally to emergency disconnect sequences, and in particular, to systems and methods for automatically and electronically initiating, triggering, and/or executing an emergency disconnect sequence ("EDS") in connection with an offshore drilling platform.

In some offshore drilling operations, a wellhead at the sea floor is positioned at the upper end of the subterranean wellbore lined with casing. A blowout preventer ("BOP"), or BOP stack, is mounted to the wellhead, and a lower marine riser package ("LMRP") is mounted to the BOP stack (e.g., via LMRP connector). The LMRP is connected to a vessel such as a drilling vessel located at the sea surface via a drilling riser, or riser, which, in some cases, may be hundreds to thousands of feet long. The drilling riser provides a conduit to extend a drill string from the surface vessel into the LMRP, the BOP stack, the wellhead and, ultimately, the wellbore. To accommodate movement of the vessel, LMRPs typically include a flex joint coupled to the lower end of the drilling riser. In the event of an emergency, an EDS can be initiated to separate or disconnect the vessel from the wellhead.

Given the geometrical relationship between the vessel and the wellhead, the degree to which the vessel can deviate safely from the wellhead has a direct relationship with, and/or is based at least in part on, the water depth. As water depth decreases, for example, the degree to which vessel motion can deviate safely (e.g., such that the drilling operations can continue, or at least such that the vessel can remain safely attached to the wellhead) decreases. So, as water depth decreases, operating tolerances and the amount of time available to react or respond to adverse or hazardous operating conditions and emergency-related events, such as failure to maintain station, also decrease. In fact, operating in increasingly shallow water depths can reduce the amount of time available to respond to adverse or hazardous operating conditions to such an extent that the time it takes a conventional offshore drilling platform to effectively execute an emergency disconnection sequence is greater than the available amount of time to prevent potential catastrophic failure. This makes conventional systems, such as those described in herein, unsuitable to enable the vessel to operate safely (e.g., because they are incapable of releasing the vessel fast enough) in shallow water depths, as they are not capable of rapidly initiating and executing an EDS within the available amount of time a vessel may have to initiate and execute the EDS to prevent potential catastrophic failure.

Accordingly, there is a need for a rapid EDS that can be executed and completed (e.g., in the event of station keeping failure) rapidly, such as for use in shallow water drilling operations, and the like. An automated and electronically initiated and/or executed disconnect system whereby sealing the wellbore and unlatching the LMRP can be performed rapidly can improve the operating circle within which vessels can safely operate. Further, providing such a rapid and dependable disconnect system to separate the vessel from the wellhead, can optimize (e.g., enlarge) the operating circle within which the vessel can safely operate.

SUMMARY

According to various aspects of the present disclosure, a disconnection system is provided. In an aspect, the disconnection system is configured to initiate an emergency disconnect sequence (EDS), and includes a controller including a processor and a memory operably coupled to the processor. The controller can be configured to receive, from a set of motion reference units operably coupled to a flexible joint, position data generated by the set of motion references units and associated with the flexible joint when the flexible joint is operably coupled to and disposed between a drilling riser and a lower marine riser package (LMRP). The controller can be configured to determine, based on the position data, an angular offset of the flexible joint. The controller can be configured to send, to a subsea control pod disposed at or adjacent to the LMRP, a trigger signal in response to determining that the angular offset exceeds a predetermined threshold, such that the subsea control pod initiates the EDS.

According to various aspects of the present disclosure, a disconnection method is provided. In an aspect, the disconnection method includes receiving, at a controller and from a set of motion reference units, position data associated with a flexible joint that is disposed subsea between a drilling riser and a lower marine riser package (LMRP). Further, the disconnection method includes determining, at the controller and based on the position data, an angular offset of the flexible joint. Further, the disconnection method includes sending, from the controller and to a subsea control pod, a trigger signal in response to determining that the angular offset exceeds a predetermined threshold such that the subsea control pod initiates an emergency disconnect sequence (EDS).

According to various aspects of the present disclosure, a non-transitory processor readable medium storing code representing instructions for execution by a processor is provided. In an aspect, the instructions may be executed by the processor to receive, from a set of motion reference units operably coupled to a flexible joint, position data generated by the set of motion references units and associated with the flexible joint when the flexible joint is operably coupled to and disposed between a drilling riser and a lower marine riser package (LMRP). Further, the instructions may be executed by the processor to determine, based on the position data, an angular offset of the flexible joint. Further, the instructions may be executed by the processor to send, to a subsea control pod disposed at or adjacent to the LMRP, a trigger signal in response to determining that the angular offset exceeds a predetermined threshold, such that the subsea control pod initiates the EDS.

BRIEF DESCRIPTION OF THE DRAWINGS

The drawings are not necessarily to scale. The drawings are merely schematic representations, not intended to portray specific parameters of the invention. The drawings are intended to depict only typical embodiments of disclosed systems, apparatus, and methods. In the drawings, like reference characters refer to like elements (e.g., functionally similar and/or structurally similar elements).

DETAILED DESCRIPTION

Figure 1:
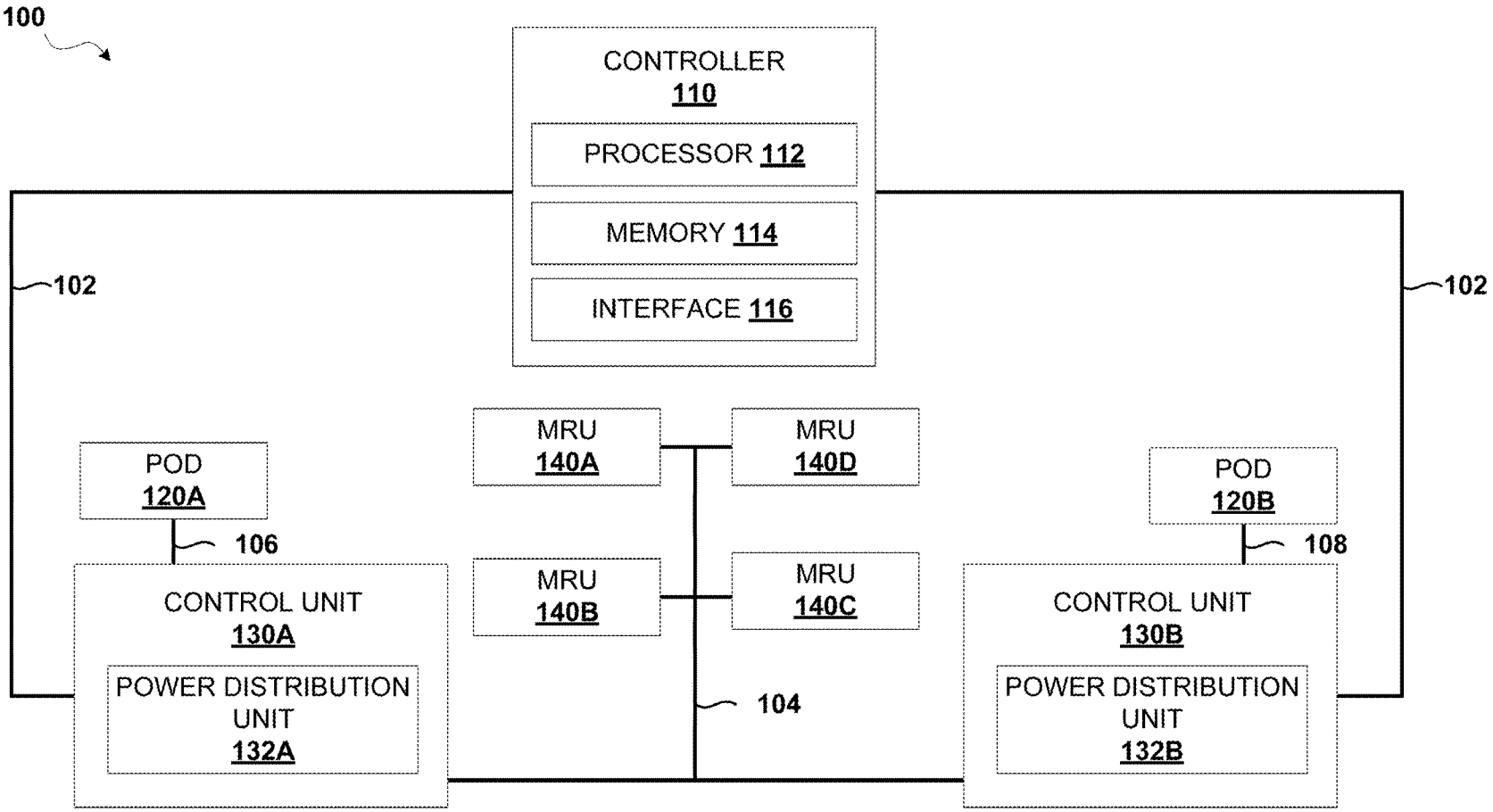
FIG. 1 is a functional block diagram depicting a disconnect system, according to an embodiment.

Embodiments of the present disclosure are directed to systems and methods for automatically (e.g., without user intervention and in real-time) and electronically initiating, triggering, and/or executing an emergency disconnect sequence ("EDS") in connection with an offshore drilling platform.

For context, an offshore drilling platform can include at least a vessel, a riser, a flex joint, a blowout preventer ("BOP"), and a wellhead. More specifically, the BOP is secured to the well via the wellhead, and the vessel is removably secured to the BOP via the riser, with the flex joint being disposed between the riser and the BOP to allow for relative movement between the vessel and the BOP.

The offshore drilling platform can be or include, for example, an oil platform, offshore platform, offshore drilling vessel, offshore drilling rig, tension-leg platform, or the like. In use, the offshore drilling platform can be free-floating (i.e., untethered to a seabed, other than conduit and safety components disposed between the vessel and the wellhead). For example, in some instances, the offshore drilling platform can include a free-floating, semi-submersible offshore drilling vessel. The offshore drilling platform can otherwise be or include any other type of natural resource drilling platform, offshore platform, drilling rig, marine vessel, or the like, such as one having facilities to perform a drilling operation, or otherwise, for well drilling to explore, extract, store, and process natural resources, such as petroleum or natural gas from a subsea geographic formation, or any other type of formation, in accordance with embodiments of the present disclosure.

The vessel can be or include any type of marine vessel, drilling vessel, semi-submersible vessel, or the like. In some instances, the vessel can be or include a mobile, offshore drilling vessel having a buoyant hull (e.g. having columns, pontoons, buoyancy tanks), capable of controlled movement from place to place, ballasting up or down (e.g. by altering the amount of flooding in buoyancy tanks, etc.), and so on. In some implementations, the vessel is configured to operate in a shallow water depth of anywhere between about 450 feet to about 1,000 feet. In some implementations, the vessel is configured to operation in a shallow water depth of less than about 450 feet.

The riser is a conduit such as a drilling riser or marine riser pipe configured to provide for access (e.g., for drilling tools and operations) and fluid communication between, for example, the vessel and the BOP. The riser extends between the vessel (e.g., positioned at water surface) and the BOP during a drilling operation. The riser can be configured to establish fluid communication with the wellhead via coupling to (and terminating at) the flexible joint disposed at or about an upper surface or region of the BOP (e.g., at a top surface of an upper BOP stack/LMRP). The flexible joint can include any suitable type of flexible joint configured to fluidically couple the riser and the BOP, and allow for some relative movement therebetween. In general, the riser can be or include any suitable type of conduit that can be used, for example, for well drilling and/or during a drilling operation to explore, extract, store, and process natural resources, such as petroleum or natural gas, from a subsea geographic formation, or any other type of formation, in accordance with embodiments of the present disclosure.

The wellhead represents a structural interface extending from a surface of a geographic formation such as a subsea well or wellbore. In some implementations, the wellhead can be positioned or located at a shallow water depth of less than 450 feet. In some implementations, the wellhead can be positioned or located at a shallow water depth of less than 1,000 feet. The wellhead can otherwise be positioned or located at any non-deepwater depth, in accordance with embodiments of the present disclosure.

The BOP is a safety device, and includes an upper BOP stack (LMRP) and a lower BOP stack. The BOP can be used to close, isolate, and/or seal a wellbore, such as to prevent or mitigate an inadvertent or unintended release of high-pressure fluid from the wellhead (e.g., during a drilling or production operation). The upper BOP stack and the lower BOP stack can include various devices (e.g., rams) designed to isolate the wellbore, such as by shearing a tubular disposed within the wellbore and/or by sealing the wellbore. The upper BOP stack may include a lower marine riser package ("LMRP") designed to seal the wellbore, and, in some instances, to shear pipes and/or related equipment that are disposed within the wellbore. Generally, the LMRP is configured to operate as part of a workover system that includes a series of valves coupled to high strength pipe by which a drilling riser can connect. The LMRP may include, for example, two control systems or pods, with each control pod being associated with a separate hydraulic supply conduit and containing electronics and valves that are used for monitoring and control of a wide variety of functions related to drilling operations.

In use, such as during an offshore drilling operation, the vessel operates unanchored and untethered to any fixed or solid ground, aside from the conduit, which is not designed to act as a load-bearing or anchoring component and cannot be used to sufficiently anchor the vessel. That is, while the vessel is coupled to the wellhead (which is fixed to the seabed) via the riser, the flex joint, and the BOP, the riser and BOP are not designed to maintain (e.g., anchor, tether, etc.) the vessel in a safe and operable position relative to the well during the drilling operation. Thus, the vessel cannot safely rely on its connection to the wellhead via the riser and/or the BOP to maintain station. As a result, the vessel effectively operates in a free-floating condition and must maintain position, that is, within an acceptable operating zone, distance, area, orientation and/or range of a position of the formation with which it is connected (e.g., via BOP), in order to prevent any of the components coupled to and/or disposed between the vessel and the wellhead from inadvertently disconnecting from the well, and/or being subject to undesirable forces that can contribute to equipment failure. Maintaining this position is referred to as "station keeping."

While maintaining such a fixed position over long periods of times is essential, particularly in shallow water, a failure to maintain station can still occur. In one respect, the nature of being out in open water with few if any reference points can make navigation difficult. For example, given that the vessel is essentially free-floating in a body of water, or otherwise floating without being sufficiently anchored to the seabed, the vessel's position is particularly vulnerable to and impacted by adverse weather conditions, turbulent water conditions, and the like. Movement of the vessel relative to the wellhead, in response to those weather conditions or any other factor that may impact the vessel's position, for example, beyond certain thresholds may in some instances interfere with various drilling operations (e.g., offsetting the vessel from the wellhead such that drilling must stop). For example, movement of the vessel relative to the wellhead beyond certain thresholds may lead to equipment failure, resulting in potential danger to the environment and the crew stationed on the vessel. Operating in shallow waters reduces operating tolerances and, consequently, the thresholds beyond which can lead to such equipment failure. For context, as an example, in certain shallow water environments, about a 1% offset may cause or require a ceasing of drilling operations, and about a 4% offset may require an emergency disconnection.

Given that the vessel is free-floating, to perform station keeping or otherwise maintain station, the offshore drilling platform can include and execute a control system (not depicted), such as, for example, a dynamic positioning (DP) control system ("DP control system" or "dynamic control system"). For example, the vessel may implement a DP control system to control vessel motion such as described in additional detail in U.S. Pat. No. 9,783,199 B2, filed on Mar. 11, 2016 and titled "Dynamic Positioning (DP) Drive-off (DO) Mitigation with inertial navigation system" ("the '199 Patent"), the disclosure of which is incorporated by reference herein in its entirety. Additional technologies designed to improve dynamic positioning and station keeping reliability can include, for example, hybrid power, inertial reference, taut line reference, AGP, AD-CAP, and/or the like.

In addition to, or aside from, the vessel failing to keep station due to adverse weather conditions, and/or faulty station monitoring, in some instances, the DP control system itself may fail, resulting in driving the vessel off station, also referred to as a drive off event. A drive-off event in which a vessel deviates too far from the wellhead to which it is connected, can expose the vessel to risk of inadvertent disconnection, loss, and/or damage. In other words, a drive-off event is an event in which the DP control system fails to operate properly, causing the vessel to be "driven off," moved outside of, or otherwise deviate too far from its preferred position, or within station. Accordingly, disaster mitigation and detection measures are important, and the quality, accuracy, and speed or response time under or by which these measures can sufficiently operate can become increasingly critical and difficult to achieve, particularly in shallow water, and the like.

A station keeping emergency event can be detected in response to determining that an operating parameter, such as an angular offset (also referred to herein as "angle of operation") between the riser and the upper BOP stack (and/or between the flexible joint and the upper BOP stack, or of the flexible joint itself with respect to the upper BOP stack), has exceeded a predetermined threshold value, or range of values. Said another way, the operating angle can represent or correspond to a degree to which the vessel is offset, such as from a neutral position with respect to the wellbore, defined, for example, based on the longitudinal central axis of the wellbore, i.e., a preferred operation position for the vessel. For example, one or more operating angles between the flexible joint, and/or the riser and the upper BOP stack (e.g., associated with operating angles corresponding to operating specifications or limits of the flexible joint) can be based on one or more corresponding operating positions of the vessel, and further, defined and associated with one or more corresponding operating zones or boundaries (e.g. safe operating zones, hazardous operating zones, dangerous operating zones), so as to define zones within which to maintain station and position of the vessel. Accordingly, the safe, hazardous, and dangerous operating zones may be used to define or delimit the extent or amount of movement or positioning tolerance available to the vessel during an operation.

In some instances, the operating parameter can include or be defined as, for example, an angular offset corresponding to a critical release angle. In some instances, the critical release angle can be defined, determined, and/or modeled in real-time (e.g. during a drilling operation), and as discussed in further detail herein represents or corresponds to the angle(s) at or beyond which continued connection of the vessel to the wellhead (e.g., via the riser and the flex joint at the BOP) can be too dangerous.

As described herein, the BOP is coupled to the wellhead 106 via its lower BOP stack, and includes a bore (e.g., a throughbore) aligned with the wellbore of the wellhead. The BOP can be configured to establish, facilitate, and maintain fluid communication between the riser and the wellhead. For example, in some implementations, the riser can be coupled to and terminate at the upper BOP stack 110A via coupling to the flexible joint. As discussed in further detail herein, in certain safety-related and/or emergency-related instances, in use (e.g., during a drilling operation), it is desirable to separate the vessel from the well. Accordingly, the lower BOP stack is removably coupled and/or removably latched to the upper BOP stack such that, when uncoupled or unlatched, the vessel, riser, flex joint, and the LMRP can collectively be physically released from the lower BOP stack and the wellhead such that the vessel, riser, flex joint, and LMRP can float freely relative to the lower BOP stack and the wellhead.

Given the geometrical relationship between the vessel and the wellhead, the degree to which the vessel can deviate safely from the wellhead has a direct relationship with, and/or is based at least in part on, the water depth. As water depth decreases, for example, the degree to which vessel motion can deviate safely (e.g., such that the drilling operations can continue, or at least such that the vessel can remain safely attached to the wellhead) decreases. So, as water depth decreases, operating tolerances and the amount of time available to react or respond to adverse or hazardous operating conditions and emergency-related events, such as failure to maintain station, also decrease. In fact, operating in increasingly shallow water depths can reduce the amount of time available to respond to adverse or hazardous operating conditions to such an extent that the time it takes a conventional offshore drilling platform to effectively execute an emergency disconnection sequence is greater than the available amount of time to prevent potential catastrophic failure. This makes conventional systems, as described in further detail herein) unsuitable to enable the vessel to operate safely (e.g., because they are incapable of releasing the vessel fast enough) in shallow water depths.

Accordingly, there is a need for a rapid EDS that can be executed and completed (e.g., in the event of station keeping failure) rapidly, such as for use in shallow water drilling operations, and the like. An automated and electronically initiated and/or executed disconnect system whereby sealing the wellbore and unlatching the LMRP can be performed rapidly can improve the operating circle within which vessels can safely operate. Further, providing such a rapid and dependable disconnect system to separate the vessel from the wellhead, can optimize (e.g., enlarge) the operating circle within which the vessel can safely operate.

FIG. 1 is a functional block diagram depicting a disconnect system ("disconnect system 100") configured to initiate, trigger, and/or otherwise execute an EDS, according to an embodiment. As described above, disconnect system 100 can be used in or with a vessel (not shown) during a drilling operation, in which the vessel is tethered to a formation such as a wellhead (not shown) by a riser (e.g., a non-load bearing riser, a drilling riser, a marine riser pipe, etc.) (not shown) extending between the vessel and a BOP (not shown) that is coupled to the wellhead. The BOP can include an upper BOP stack and a lower BOP stack. The lower BOP stack can include, for example, a wellhead connector to fixedly couple the lower BOP stack to the wellhead, any suitable number and/or type of blow out preventers (e.g., ram and/or annular), choke valves, kill valves, and/or the like. The upper BOP stack can include a LMRP. The LMRP can include a connector configured to unlatch the LMRP from the lower BOP stack, and to thereby release the vessel, riser, flex joint, and LMRP from the wellhead.

As shown in FIG. 1, disconnect system 100 includes a controller 110, a first control unit 130A and a second control unit 130B, a first pod 120A and a second pod 120B (also referred to collectively as "pods 120A-B", or "subsea control pods 120A-B"), and four motion reference units (collectively referred to as "MRUs 140A-D" or individually as "MRU 140A", "MRU 140B", "MRU 140C", and "MRU 140D"), interconnected over one or more channels, paths, links, and/or connections, as described in further detail herein. While disconnect system 100 is shown and described as including a certain number of components, other arrangements with other numbers of components can be contemplated.

Controller 110 can be or include any suitable type of controller and/or processing device configured to read, write, run, and/or execute data and/or signals corresponding to instructions, commands, logic, code, software, applications, programs, and/or the like. For example, controller 110 can include a programmable logic controller (PLC), and the like. As shown in FIG. 1, in this embodiment, controller 110 includes a processor 112, a memory 114, and an interface 116. Controller 110 can be configured to disposed, for example, at surface level, such as at, about, and/or on board a vessel, as described herein.

Processor 112 can be or include any suitable type of processing device configured to run and/or execute instructions, commands, logic, code, software, applications, programs, and/or the like. For example, processor 112 can include a hardware-based integrated circuit (IC), a general purpose processor, a central processing unit (CPU), an application specific integrated circuit (ASIC), a field programmable gate array (FPGA), a programmable logic array (PLA), a complex programmable logic device (CPLD), and/or the like. Processor 112 can be operatively coupled to memory 114, such as by way of data transfer (e.g., via a bus such as an address bus, data bus, control bus, and/or the like).

Memory 114 can include any suitable type of memory, data storage, and/or machine-, processor-, or computer-readable media (collectively, "computer-readable medium" or "computer-readable media"), capable of storing instructions, commands, logic, code, software, applications, programs, and/or the like, such as for execution by a processor such as processor 112. For example, memory 114 can include a semiconductor storage and/or memory such as random access memory (RAM), erasable programmable read only memory (EPROM), electrically erasable programmable read only memory (EEPROM), read only memory (ROM), and/or the like. As another example, memory 114 can include cache memory, memory buffers, hard drives, databases, flash memory, hard disks, floppy disks, cloud storage, magnetic or optical tape or disk (e.g. of an internal hard drive), CD-ROM, DVD, and/or the like. In general, memory 114 can include any suitable type of computer-readable medium (e.g., tangible storage device) configured to store instructions, commands, logic, code, software, applications, and/or programs, including, for example, an application such as a native application, a web or web-based application, a hybrid application (e.g., an application having a combination of native and web-based application characteristics or functionality), and/or the like.

Interface 116 can include any suitable type of interface and/or interface device, configured to enable, support, or otherwise provide for user interaction between a user, controller 110, and/or control units 130A-B, as described in further detail herein. For example, interface 116 can include a human-machine interface, human-computer interface, batch interface, graphical user interface (GUI), and/or the like. As another example, interface 116 can include one or more input devices such as a keyboard and mouse, and one or more output devices such as displays, screens, projectors, and the like (e.g., as in a control panel). As another example, interface 116 can include one or more input/output (I/O) devices such as a touchscreen, a holographic display, an optical head-mounted display, a virtual reality display, an augmented reality display, and/or the like. Interface 116 can otherwise include any suitable type of interface capable of embodiment in conjunction with a device such as controller 110 to enable monitoring and/or control of disconnect system 100 (e.g., by a user), as described herein.

Channel 102, channel 104, channel 106, and/or channel 108 can be or include any suitable type of channel, path, link, or connection (e.g., unidirectional channel, bidirectional channel), configured to enable and support interconnection and interoperation, including data communications, power transmission, and power distribution, between and amongst controller 110, control units 130A-B, pods 120A-B, and MRUs 140A-D, as described in further detail herein. For example, channel 102, channel 104, channel 106, and/or channel 108 can include one or more channels by which data, signals, and/or power can be communicated, transmitted, propagated, and/or distributed between and amongst controller 110, control units 130A-B, pods 120A-B, and MRUs 140A-D. As another example, channel 102, channel 104, channel 106, and/or channel 108 can include wired (e.g., optical fiber, copper wire) connections. In some embodiments, channel 102, channel 104, channel 106, and/or channel 108 can include, for example, a cable, such as a multiplexed or multiplexing cable, and the like ("MUX cable" or "multiplexing cable"). Channel 102, channel 104, channel 106, and/or channel 108 can otherwise include or be used in conjunction with any suitable combination of connections and protocols, configured to enable and support interconnection, communications, transmissions, and interoperations between controller 110, control units 130A-B, pods 120A-B, and MRUs 140A-D, as described herein. The signals can include any suitable type of signals, including, for example, optical and/or electrical signals such as frequency tunable signals, coherent signals, and/or the like.

Pod 120A and/or pod 120B can be or include any suitable type of pod, control pod, and/or the like, that can be configured to control, implement, facilitate, and/or execute various BOP functions in and of a BOP, such as described herein. Pod 120A and/or pod 120B can be disposed and implemented subsea, such as in conjunction with the BOP, via interconnection in and to the BOP (e.g., via interconnection with a modular valve block of the BOP), such as at the upper BOP stack, or LMRP. Pod 120A and/or pod 120B can include any suitable combinations of valves (e.g., shuttle valves), gauges, piping, instrumentation, accumulators, regulators, and the like. As an example, pod 120A and/or pod 120B can be configured to control, implement, facilitate, and/or execute various BOP functions, including, for example, opening, closing, isolating, and/or sealing a wellbore (e.g., to which the BOP is attached), such as by actuating one or more ram(s) (e.g., shear rams, pipe rams, annular seals, etc.) to close an annular, to shear a tubular member or component disposed within the wellbore, and/or the like. As another example, pod 120A and/or pod 120B can be configured to control, implement, facilitate, and/or execute various BOP functions, including, for example, actuating one or more valves (e.g., solenoid valves) in, of, and/or interconnected to the BOP, such as to control the flow of drilling fluids (e.g., via or through a flex joint and riser interconnecting a vessel to the wellbore at the BOP), and other well entry and/or re-entry equipment.

Control unit 130A and/or control unit 130B can include any suitable type of controller and/or processing device configured to read, write, run, and/or execute data and/or signals corresponding to instructions, commands, logic, code, software, applications, programs, and/or the like. For example, control unit 130A and/or control unit 130B can include a programmable logic controller (PLC), a controller, a data logger, and/or the like. As another example, control unit 130A and/or control unit 130B can each include a processor (not shown) and a memory (not shown). For example, the processor and the memory can be structurally and/or functionally similar to processor 112 and memory 116. Control unit 130A includes a power distribution unit 132A and is operatively coupled to pod 120A via channel 106, and further, control unit 130B includes a power distribution unit 132B and is operatively coupled to pod 120B via channel 108, as shown in FIG. 1. Further, control unit 130A and control unit 130B are each operatively coupled to each of the MRUs 140A-D via channel 104. Control unit 130A and/or control unit 130B can be configured to be implemented in a subsea environment. In some implementations, control unit 130A and/or control unit 130B can be disposed at or embedded in pod 120A and/or pod 120B. For example, control unit 130A and pod 120A, and/or control unit 130B and pod 120B can be disposed in a common or interconnected housing. In some implementations, control unit 130A and/or control unit 130B can alternatively or otherwise be disposed at or embedded in an LMRP. Control unit 130A and/or control unit 130B can otherwise be disposed in any suitable manner, in accordance with embodiments of the present disclosure.

Although in this embodiment control unit 130A and control unit 130B are shown and described as sharing channel 104 to communicate with MRUs 140A-D, in other embodiments, any number and/or arrangement of channels can be used. In some embodiments, for example, control unit 130A can be coupled to MRUs 140A-D via a first channel, and control unit 130B can be coupled to MRUs 140A-D via a second channel that is separate and distinct from the first channel.

Power distribution unit 132A and/or distribution unit 132B can include any suitable type of power distribution unit, energy storage system, and/or the like, that is configured to receive, store, and/or distribute power. For example, power distribution unit 132A and distribution unit 132B can be configured to receive power over channel 102. As another example, control unit 130A and control unit 130B can each be configured to store and/or distribute power via a power distribution unit (e.g., power distribution unit 132A and/or power distribution unit 132B). In some implementations, power distribution unit 132A and/or distribution unit 132B can be configured to send, transmit, supply, and/or distribute power to a set of sensors, and the like. For example, power distribution unit 132A and distribution unit 132B can be configured to distribute power to MRU 140A, MRU 140B, MRU 140C, and/or MRU 140D over channel 104. Power distribution unit 132A and power distribution unit 132B can include any suitable type of energy or power storage device, transfer device, distribution device, supply (e.g., power supply, energy supply), power source, and/or the like. For example, power distribution unit 132A and/or power distribution unit 132B can include a battery, a bank of batteries, and/or the like. Power distribution unit 132A and power distribution unit 132B can be configured to selectively activate, energize, and/or supply power to MRUs 140A-D, as described in further herein.

MRU 140A, MRU 140B, MRU 140C, and MRU 140D can be or include any suitable type of motion reference unit (e.g., including one or more transducers, sensors, etc.) that is configured to sense, detect, and/or measure a variable or parameter (relative or absolute) of or associated with a flexible joint. The variable or parameter can include, for example, linear or angular motion, position, and/or orientation of the flexible joint, and/or a parameter related to the motion, positioning and/or orientation of the flexible joint. MRUs 140A-D can be configured to measure an orientation and/or angular velocity of the flexible joint. For example, MRUs 140A-D can each include a sensor configured to measure a position, velocity, acceleration, angular position, angular velocity, angular acceleration, orientation (e.g., pitch, roll, and/or heave), attitude, and/or the like (collectively referred to herein as "position" or "measured parameter") of the flexible joint. MRUs 140A-D can be configured to measure the position of the flexible joint with respect to any suitable type of reference, object, and/or reference frame.

MRU 140A, MRU 140B, MRU 140C, and MRU 140D can be configured to generate data corresponding to the parameter, including, for example, a position or measured parameter of or associated with the flexible joint. For example, MRUs 140A-D can be configured to detect a position of the flexible joint, and further, to generate data ("position data" or "positioning data") corresponding to the position of the flexible joint. In some implementations, MRUs 140A-D can be configured to generate position data based on and corresponding to the detected position of the flexible joint. In some implementations, MRUs 140A-D can each include or be included in a Mark IV Subsea MUX BOP Control System, an MRU5+ Mark IV in subsea bottles, and/or the like, from Schlumberger Limited of France.

MRUs 140A-D can be disposed, for example, on, at, or about the LMRP, the flexible joint, a receiver plate, a receptor plate, and/or the like. The receiver plate and/or the receptor plate, for example, can be a part of or coupled to a structural frame of the LMRP. In some implementations, for example, MRU 140A and MRU 140D can be disposed on or adjacent to one or more surfaces of the flexible joint, and MRU 140B and MRU 140C can be disposed on or adjacent to one or more surfaces of the receiver or receptor plate. In some implementations, two MRUs (e.g., any of MRU 140A, MRU 140B MRU 140C, and MRU 140D) can be disposed on or at surfaces of the flexible joint. In such implementations, two other MRUs (e.g., of those remaining from MRUs 140A-D) can be disposed at, about, or adjacent to the receiver plate, such as at a position adjacent to a surface or part of the receiver plate. MRUs 140A-D can otherwise be disposed in any other manner, suitable for enabling MRUs 140A-D to detect the position of the flexible joint, and to generate position data corresponding to the position of the flexible joint, as described herein.

As an example, control unit 130A and control unit 130B can be configured to receive position data from MRUs 140A-D. The position data can include data corresponding to a position of or associated with the flexible joint. For example, the position data can include data corresponding to and/or associated with a measure of a property, characteristic, or condition of or associated with the flexible joint, including, for example, a position of the flexible joint, an angular position of the flexible joint, an orientation and/or attitude of the flexible joint, and/or the like, as described herein. In some implementations, control unit 130A and/or control unit 130B can receive the position data over channel 104 and from MRU 140A, MRU 140B, MRU 140C, and/or MRU 140D. Control unit 130A and/or control unit 130B can be configured to determine, based on the position data, an operating parameter (e.g., angular offset) of the flexible joint, as described herein. In some implementations, control unit 130A and/or control unit 130B can be configured to calculate or otherwise determine an angular offset and/or an angle of operation of the flexible joint based on the received position data. For example, the angular offset can be defined as an offset, such as an angular or radial offset, of one or more parts or portions of the flexible joint from a neutral position, and/or from an axis, such as a longitudinal axis of the LMRP, and/or the like.

In use, disconnect system 100 can be configured to automatically (e.g., without user intervention in real-time) initiate, trigger, and/or otherwise execute an EDS in response to detection and/or determination of an operating parameter exceeding a predetermined threshold, a failure (or anticipated failure) to keep station, and/or the like. For example, with the MRUs 140A-D operatively coupled to the flexible joint (and/or other related components), the MRUs 140A-D can measure position(s) of the flexible joint (and/or the other related components) and generate position data in real-time. The MRUs 140A-D can then send that position data via channel 104 to both control unit 130A and control unit 130B. For example, in response to and/or based on the position data, control unit 130A and control unit 130B can be configured to (independent from each other) determine, one or more operating parameters of the flexible joint, including, for example, an angle of operation and/or an angular offset of the flexible joint, as described in further herein. With the operating parameter(s), each control unit 130A and control unit 130B can then compare the operating parameter(s) to a predetermined threshold. In instances in which at least one of control unit 130A or control unit 130B determines based on that comparison that the operating parameter(s) meet or exceed the predetermined threshold, control unit 130A and/or control unit 130B can generate a trigger signal based on and/or in response to determining that the operating parameter (e.g., angular offset, angle of operation) meets or exceeds the predetermined threshold.

The trigger signals can be sent, for example, from control unit 130A and control unit 130B and to pod 120A and 120B, respectively, to initiate an EDS via pod 120A and/or pod 120B. In some implementations, the trigger signals can be sent in response to determining that the angle of operation and/or the angular offset of the flexible joint exceeds the predetermined threshold. More specifically, control unit 130A can be configured to generate a trigger signal, and further, to send the trigger signal to pod 120A via channel 106; moreover, control unit 130B can be configured to generate a trigger signal, and further, to send the trigger signal to pod 120B via channel 108, such as shown in FIG. 1. The trigger signal can be sent (e.g., from control unit 130A and to pod 120A; from control unit 130B and to pod 120B) to initiate an EDS. The trigger signal can be or include, for example, an electrical signal, a digital signal, an optical signal, and/or the like.

In some implementations, control unit 130A and/or control unit 130B can be configured to send a trigger signal (e.g. to pod 120A and/or pod 120B) in response to determining that the determined operating parameter, (e.g., the determined angular offset) exceeds a predetermined threshold, as described herein. For example, having received the position data, control unit 130A and/or control unit 130B can be configured to determine an operating parameter (e.g., angular offset of the flexible joint) based on the received position data, and further, to send a trigger signal to the pods 120A-B in response to determining that the operating parameter meets or exceeds the predetermined threshold.

In some implementations, a predetermined threshold can be defined to represent, correspond to, or otherwise include an angular offset limit, or critical release angle, at or beyond which continued connection of the vessel to the wellhead (e.g., via the riser and the flex joint at the BOP) can result in failure (e.g., of the flexible joint). For example, the predetermined threshold can include and/or correspond to a critical release angle, which can be defined, measured, determined, and/or modeled dynamically and/or in real-time, such as in the form of a value, limit, or range of values or limits. In some instances, the predetermined threshold can be, include, or be defined as a threshold or maximum value, limit, or extent corresponding to the magnitude of the angular offset of the flexible joint beyond which preemptive safety measures (e.g., initiating an EDS) can be taken. In other instances, the predetermined threshold can be, include, or be defined as a set or range of values, limits, or extents corresponding to a range of magnitudes of the angular offset of the flexible joint beyond which associated preemptive safety measures can be taken. For example, in some instances, the predetermined threshold can be defined as range or series of values corresponding to a range or series of magnitudes of the angular offset of the flexible joint, beyond which associated preemptive safety measures can be taken. In some implementations, the predetermined threshold can be defined, for example, based on an operating limit, operating specification, and/or operating condition of the flexible joint. In this example, the range or series of values corresponding to the range or series of magnitudes of the angular offset of the flexible joint can include, for example, a series of values, limit, or extent corresponding to magnitudes of the angular offset of the flexible joint beyond which exposure of the vessel to operational risk becomes increasingly greater.

In some implementations, the range or series of values corresponding to the range or series of magnitudes of the angular offset can include, for example, a caution limit, a warning limit, a danger limit, an emergency limit, and/or the like. For example, control unit 130A and/or control unit 130B can be configured to send the trigger signal to initiate the EDS in response to determining that the operating parameter (e.g., a determined angular offset of the flexible joint) exceeds the emergency limit; as another example, control unit 130A and/or control unit 130B can be configured to send a warning signal to initiate a warning in response to determining that the operating parameter (e.g., a determined angular offset of the flexible joint) exceeds the warning limit; and so on. In some implementations, in response to determining that the operating parameter meets or exceeds the predetermined threshold, control unit 130A can be configured to send a trigger signal to pod 120A via channel 106, and/or control unit 130B can be configured to send a trigger signal to pod 120B via channel 108.

For example, an operating parameter such as an angular offset of a flexible joint can be determined based on the position data, which can include data corresponding to one or more measures of an absolute or relative angular position, velocity, acceleration, and/or motion of the flexible joint and/or a portion of the flexible joint. In some implementations, for example, the angular offset can be defined as a relative measure or ratio (e.g., a dimensionless quantity) corresponding to the relative difference between the angular position or orientation of the flexible joint in a neutral or unloaded state or condition, and the angular position or orientation of the flexible joint in a non-neutral or loaded state or condition (e.g., when the flexible joint is flexed, bent, or otherwise subject to deflection). In some implementations, as another example, the angular offset can be defined as an absolute measure (e.g., a quantity measured in degrees, radians, etc.) corresponding to the difference between the angular position or orientation of the flexible joint in a neutral or unloaded state or condition, and the angular position or orientation of the flexible joint in a non-neutral or loaded state or condition. The angle of operation, angular offset, etc., of the flexible joint can otherwise be defined in any suitable manner.

In some implementations, the predetermined threshold can be specified and/or defined based on an operating limit, value, and/or specification of the flexible joint. For example, the predetermined threshold can be defined based on an operating limit and/or operating specification of the flexible joint, such as in the form of a predetermined threshold limit or value corresponding to an operating limit of the flexible joint. As another example, the predetermined threshold can be defined based on a range of operating limits and/or operating specifications of the flexible joint corresponding to a range or series of values or operating limits (e.g., safe operating limit, hazardous operating limit, emergency operating limit, etc.) of or associated with the flexible joint. For example, the range of values or operating limits of the flexible joint can include a series of predetermined threshold limits or values corresponding to various operating limits of the flexible joint, based on various angular offsets of the flexible joint, and/or the like. For example, in some instances, the predetermined threshold can be specified based on maximum value or limit of a maximum angle of operation and/or angular offset of the flexible joint, such that the trigger signal can be sent before failure of the flexible joint occurs, or to otherwise reduce or mitigate risk of an occurrence of the failure of the flexible joint (e.g., during a drilling operation). For example, the predetermined threshold can be dynamically specified and/or defined, such as during a drilling operation, for example, based on a rate of change in position of the flexible joint (e.g., speed, velocity, and/or acceleration).

In some implementations, the predetermined threshold can be defined, measured, determined, and/or modeled in real-time (e.g. during a drilling operation). For example, the predetermined threshold can be determined and/or defined dynamically defined in real-time, such as at controller 110 and/or control unit 130A or control unit 130B. For example, the predetermined threshold can be determined based on a rate of change of a variable or parameter associated with the flexible joint, including, for example, a rate of change of the motion, position, and/or orientation of the flexible joint. In some implementations, the predetermined threshold can be dynamically defined so as to correspond to a warning, a hazardous operating condition, a dangerous operating condition, and/or the like.

In some implementations, the predetermined threshold can be specified and/or defined based on one or more motion characteristics of the flexible joint, one or more machine characteristics of the flexible joint, and/or the like. The motion characteristics may include, for example, position, velocity, and/or acceleration of the flexible joint, and/or any other spatially and/or temporally defining characteristic of the flexible joint, as described herein. The machine characteristics may include, for example, an operating limit, a type, shape (e.g. dimensions), size (e.g. volume), application, and/or any other characteristic of the flexible joint. For example, in some implementations, the predetermined threshold may be defined (e.g. by a user or machine) so as to vary in size or magnitude based on a velocity and/or acceleration of the flexible joint, such as to increase in size (e.g. angular offset range) or vary in shape or magnitude with respect to a position and/or direction of motion of the flexible joint (e.g. by decreasing in size with increasing velocity and/or acceleration of the flexible joint, etc.). In some implementations, the predetermined threshold may be defined with respect to a shape and/or size (e.g. volume) of the flexible joint, such as to correspond with operating limits and/or specifications of the flexible joint based on dimensions of the flexible joint (e.g., length, width). In some implementations, the predetermined threshold may be defined as a function of one or more environmental conditions (e.g. turbulent flow, laminar flow, flow velocity), such as to decrease in size (e.g., as in reduced-visibility conditions caused by severe weather, an event in the environment such as an explosion, a release of gas from a wellbore such as in drilling the wellbore, etc.) in the environment, and/or the like.

In some implementations, the predetermined threshold may be defined so as to dynamically (i.e. in real time) vary in characteristics (e.g. shape, size, etc.), for example, such as by increasing in size with increasing velocity of a machine (e.g. flexible joint), changing in shape with changes in acceleration of the machine, and so on. In some implementations, the predetermined threshold may be defined as a function of an operation or application of the flexible joint. For example, for dangerous operations the predetermined threshold may be configured to decrease in size or magnitude as a function of a depth at which the flexible joint is used, such as during a drilling operation (e.g., in a subsea environment).

In some implementations, disconnect system 100 (or one or more of its components) can be configured to be armed, activated, or energized, and/or disarmed, deactivated, or de-energized. In such implementations, for example, control unit 130A and/or control unit 130B can be configured to receive data, including, for example, input data, user input data, and the like ("user input data") from controller 110 (e.g., in response to input from a user at controller 110, provided, e.g., via interface 116) via channel 102. In response to receiving the user input data, for example, control unit 130A and/or control unit 130B can be configured to arm, disarm, activate, deactivate, energize, and/or de-energize disconnect system 100.

In some implementations, the user input data can be configured to define a value, bound, or limit of the predetermined threshold, as described herein. For example, the user input data can be configured to set, specify, and/or define the predetermined threshold in connection with an operating parameter, including, for example, the angular offset and/or the angle of operation of the flexible joint, such that, in response to determining that the operating parameter of the flexible joint exceeds the predetermined threshold, control unit 130A and/or control unit 130B send (e.g., to pod 120A and/or pod 120B) a trigger signal to initiate an EDS, as described in further detail herein. For example, control unit 130A and/or control unit 130B can be configured to define the predetermined threshold based on received user input data. The user input data can include, for example, a command corresponding to a specification of a limit, bound, range, magnitude, and/or value of the predetermined threshold, in connection with an operating parameter. In some implementations, the user input data can be configured to define the predetermined threshold based on a chosen operating limit or range of the flexible joint (e.g., safe operating limit or range of the joint).

In some implementations, control unit 130A and control unit 130B can each include redundant, similar, and/or substantially identical controllers and/or processing devices, to support redundancy and increase reliability (e.g., in and of disconnect system 100). For example, control unit 130A and/or control unit 130B can be configured as a backup or fail-safe controller, similar to the conventional implementation of having two pods on a BOP. For example, in the case of an occurrence of a failure event (e.g., a black-out event), such as associated with, or affecting control unit 130A, control unit 130B can be configured to be implemented as a backup or fail-safe controller such as to supply power (e.g., via power distribution unit 132B) to MRUs 140A-D, and to send and receive data (e.g., position data, trigger signal, user input data) to and from MRUS 14A-D and controller 110, as described herein. As another example, in the case of an occurrence of a failure event associated with control unit 130B, control unit 130A can be configured to be implemented as a backup or fail-safe controller such as to supply power (e.g., via power distribution unit 132B) to MRUs 140A-D, and to send and receive data (e.g., position data, trigger signal, user input data) to and from MRUS 14A-D and controller 110, as described herein.

In some implementations, control unit 130A and control unit 130B can be configured to mutually cross-check the consistency of received data (e.g., position data) and/or determinations made (e.g., of the operating parameter) based on the received data. For example, control unit 130A and control unit 130B can be configured to determine if there is a match, or a sufficient degree of consistency between the position data received at control unit 130A and control unit 130B. As another example, control unit 130A and control unit 130B can be configured to determine if there is a match, or a sufficient degree of consistency between determinations of the operating parameter of the flexible joint made at control unit 130A and control unit 130B. In some implementations, in response to determining that there is a mutual match between the received data and/or the determined operating parameter, control unit 130A and/or control unit 130B can be configured to send a trigger signal to pod 120A and/or pod 120B, as described herein. In some implementations, the trigger signal can be sent to pod 120A and/or pod 120B so as to actuate, energize, and/or activate a solenoid valve thereat (e.g., at pod 120A and/or pod 120B) to thereby initiate an EDS, as described herein. As described above, a BOP lower stack in use can be coupled to a subsea wellhead, and in some instances it is desirable to monitor fatigue of or associated with that wellhead. In some embodiments, such fatigue monitoring can be incorporated into a disconnect system.

Figure 2:
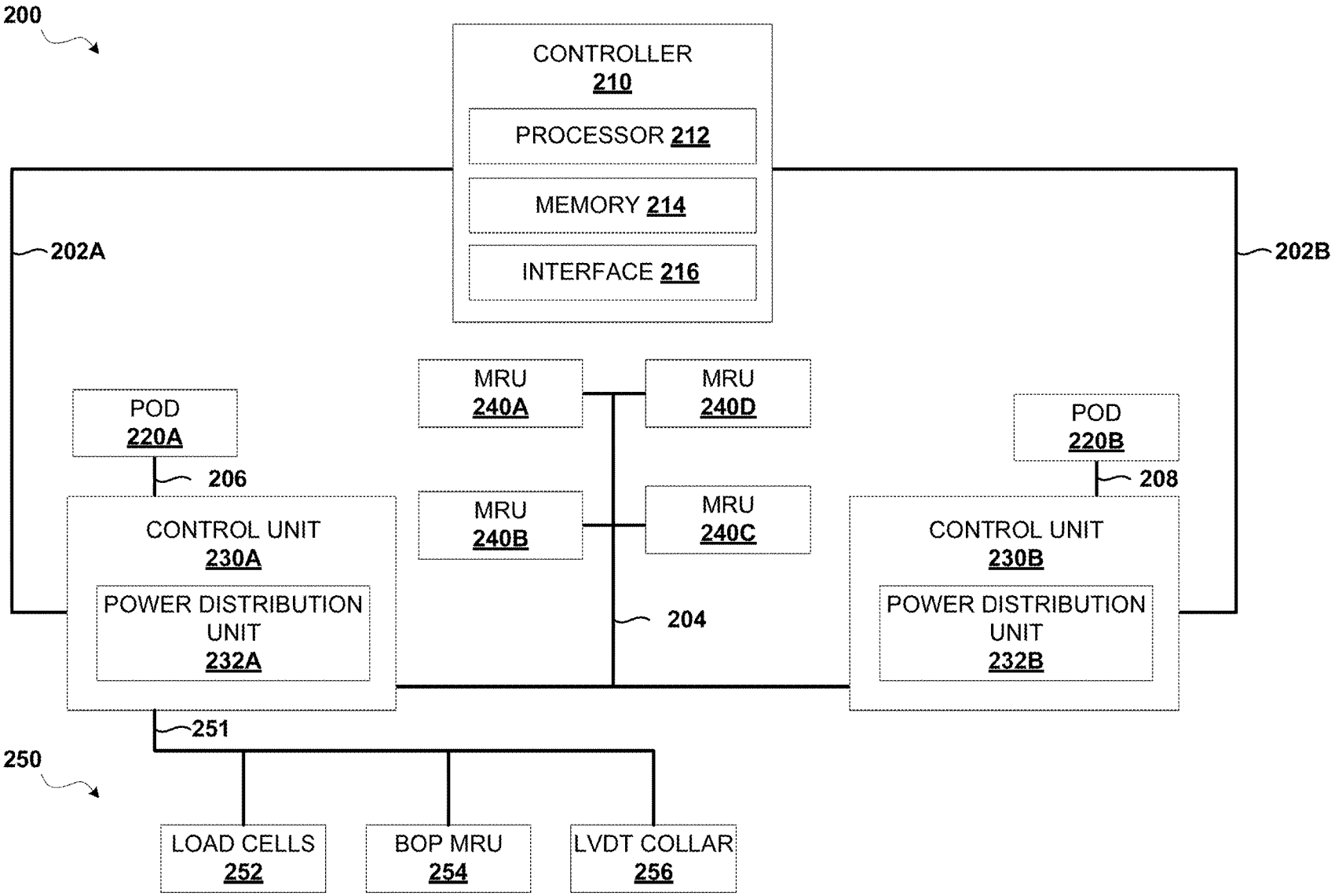
FIG. 2 is a functional block diagram depicting a disconnect system having a wellhead fatigue monitoring assembly, according to an embodiment.

FIG. 2, for example, illustrates a functional block diagram depicting a disconnect system 200 capable of monitoring fatigue of or associated with a wellhead, according to an embodiment. Disconnect system 200 can be constructed the same as or similar to, and can function the same as or similar to, disconnect system 100. Thus, portions of disconnect system 200 are not described in further detail herein. As shown in FIG. 2, disconnect system 200 includes controller 210, control unit 230A and control unit 230B, pod 220A and pod 220B, and four motion reference units, MRUs 240A-D, interconnected over channel 202, channel 204, channel 206, and/or channel 208. Further, disconnect system 200 includes a wellhead fatigue monitoring assembly 250 configured to monitor fatigue of the wellhead and/or otherwise measure and determine stresses on and fatigue (e.g., structural and/or mechanical fatigue) of or associated with the wellhead and/or one or more of its parts. As shown, the wellhead fatigue monitoring assembly is communicatively coupled to control unit 230A via channel 251 (although in other implementations it can be communicatively coupled to one or both of control units 230A-B), and includes one or more load cells 252, a BOP MRU 254, and a linear variable differential transformer ("LVDT") collar 256. While disconnect system 200 is shown and described as including a certain number of components, other arrangements with other numbers of components can be contemplated.

Channel 251 can be or include any suitable type of channel, path, link, or connection (e.g., unidirectional channel, bidirectional channel), configured to enable and support interconnection and interoperation, including data communications, power transmission, and/or power distribution, between control unit 130A and wellhead fatigue monitoring assembly 250. For example, channel 251 can be or include a channel of a type similar to that of channel 102, channel 104, channel 106, and/or channel 108, as described with reference to FIG. 1. In other embodiments, channel 251 can be configured to interconnect wellhead fatigue monitoring assembly 250 with control unit 230A and/or control unit 230B. In some implementations, channel 251 can be configured to interconnect wellhead fatigue monitoring assembly 250 with control unit 230A and/or control unit 230B via a connector such as a wet-mate connector, and/or the like.

Load cell(s) 252 can be or include any suitable type of load cell, transducer, sensor, and/or the like. For example, load cell(s) 252 can include one or more strain gauges, one or more pneumatic load cells, one or more hydraulic load cells, and/or one or more electrical load cells. Load cell(s) 252 can be configured to convert a force (e.g., applied to the wellhead), such as tension, compression, pressure, and/or torque or moment, into a signal such as an electrical signal that can be used to measure and/or determine stresses on and fatigue of or associated with the wellhead and/or one or more of one or more parts and/or components connected thereto. For example, load cell(s) 252 can be configured to detect a load or force applied to the wellhead and/or part thereof, and further, to generate data (also referred to herein as "wellhead load data") corresponding to the load or force applied to the wellhead and/or the part thereof. In some implementations, load cell(s) 252 can be configured to be pre-tensioned for use in measuring, determining, and/or monitoring stresses and/or fatigue of or associated with the wellhead and/or one or more of its parts.

BOP MRU 254 can be the same as or similar to and can function the same as or similar to the MRUs 140A-D. The BOP MRU 254, for example, can be or include any suitable type of motion reference unit (e.g., including one or more transducers, sensors, etc.) that is configured to sense, detect, measure, determine, and/or monitor a variable or parameter (relative or absolute) of or associated with a wellhead, such as motion, position, or orientation of the wellhead, and/or a parameter related to the motion, positioning or orientation of the wellhead. For example, BOP MRU 254 can include a motion reference unit that is configured to measure an orientation and/or angular velocity of the wellhead. As another example, BOP MRU 254 can include a transducer or sensor configured to measure a position, velocity, acceleration, angular position, angular velocity, angular acceleration, orientation (e.g., pitch, roll, and/or heave), and/or attitude (collectively referred to herein as "position") of the wellhead, such as with respect to a reference, object, or reference frame. In some instances, BOP MRU 254 can include a native MRU, such as may be installed in a BOP (e.g., in manufacturing the BOP) and/or sold as part of the BOP at the time of acquisition of the BOP. BOP MRU 254 can be configured to generate data corresponding to a parameter associated with the wellhead. For example, BOP MRU 254 can be configured to detect a position, deformation, and/or displacement of the wellhead and/or part thereof, and further, to generate data (also referred to herein as "wellhead MRU data") corresponding to positioning, fatigue, and/or stress of or on the wellhead, similar to or the same as described with reference to FIG. 1.

LVDT collar 256 can be or include any suitable type of linear variable differential transformer, sensor, and/or transducer that is configured to sense, detect, measure, determine, and/or monitor the positioning of the wellhead and/or one or more of its parts. For example, LVDT collar 256 can include a transducer or sensor such as an electromechanical position sensor, an electromechanical position sensor assembly, and/or the like (collectively referred to herein as "LVDT sensor"). In some implementations, the LVDT sensor can include, for example, a container or housing including a movable element therein or thereon. The movable element can include, for example, an elastic spring, a coil, and/or the like. In such implementations, the LVDT sensor can be configured to, for example, measure, determine, and/or monitor the position and/or proximity of itself relative to a target (e.g., the wellhead and/or one of its components) without physical contact with the target. LVDT collar 256 can be configured to generate data corresponding to a parameter associated with the wellhead. For example, LVDT collar 256 can be configured to detect a relative position, deformation, and/or displacement of the wellhead and/or part thereof, and further, to generate data ("wellhead LVDT data") corresponding to positioning, fatigue, and/or stress of or on the wellhead.

In use, disconnect system 200 can be configured to automatically (e.g., without user intervention in real-time) initiate, trigger, and/or otherwise execute an EDS in response to detection and/or determination of an operating parameter meeting or exceeding a predetermined threshold, a failure (or anticipated failure) to keep station, and/or the like. For example, disconnect system 200 can be configured to automatically initiate the EDS in a manner such as that described with reference to disconnect system 100. Moreover, in some instances, wellhead fatigue monitoring assembly 250 can be used in conjunction with disconnect system 200, and configured to automatically sense, detect, measure, determine, and/or monitor fatigue and/or stress on a wellhead, as described in further detail herein.

For example, during a drilling operation, BOP MRU 254 can be configured to generate wellhead MRU data, corresponding to position, deformation, and/or displacement of the wellhead and/or part thereof. Further, during the drilling operation, LVDT collar 256 can be configured to generate wellhead LVDT data, corresponding to a relative position, deformation, and/or displacement of the wellhead and/or part thereof. Further, during the drilling operation, load cell(s) 252 can be configured to generate wellhead load data, corresponding to stresses and/or fatigue of or associated with the wellhead and/or one or more of its parts. In some implementations, load cell(s) 252, BOP MRU 254, and/or LVDT collar 256 can be configured to send (e.g., over channel 251), the wellhead load data, the wellhead MRU data, and/or the wellhead LVDT data (collectively referred to herein as "wellhead data") to control unit 230A. Control unit 130A can be configured to receive the wellhead data from load cell(s) 252, BOP MRU 254, and/or LVDT collar 256, and further, to send or route the wellhead data over channel 202 to controller 210. Advantageously, sending the wellhead data to controller 210 via control unit 230A and/or control unit 230B can significantly reduce a latency in communicating the signals than could otherwise be achieved (e.g., via hydraulic systems, hydraulic signaling, etc.).

In some implementations, controller 210, control unit 230A and/or control unit 130B can be configured to determine, based on the wellhead data and during the drilling operation, stress and/or fatigue on the wellhead. In some implementations, in response to determining that the stress and/or fatigue on the wellhead meets or exceeds a predetermined threshold (e.g., predetermined threshold wellhead stress, predetermined threshold wellhead fatigue), controller 210, control unit 230A and/or control unit 230B can be configured to initiate an EDS, as described herein. For example, control unit 230A and control unit 230B can each be configured to (independent from each other) determine, one or more operating parameters of the wellhead, including, for example, wellhead stress and/or wellhead fatigue. With the operating parameter(s), each control unit 230A and control unit 230B can then compare the operating parameter (s) to a predetermined threshold. In instances in which at least one of control unit 230A or control unit 230B determines based on that comparison that the operating parameter (s) meet or exceed the predetermined threshold, control unit 230A and/or control unit 230B can generate a trigger signal based on and/or in response to determining that the operating parameter meets or exceeds the predetermined threshold.

Figure 3:
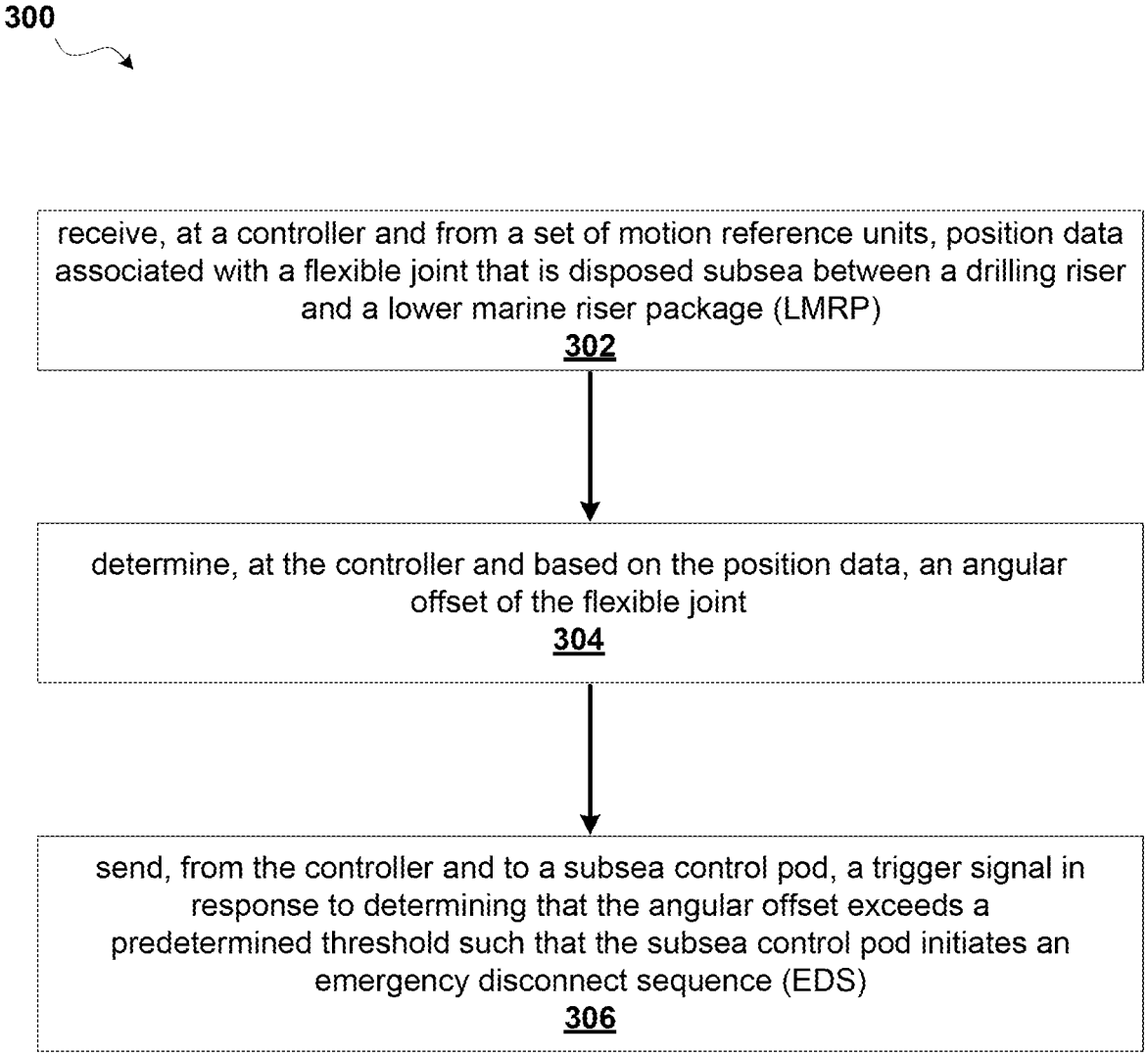
FIG. 3 is a flowchart depicting an example of a method of operating a disconnect system, according to an embodiment.

FIG. 3 is a flowchart depicting an example of a method 300 of operating a disconnect system according to an embodiment. Method 300 can be implemented, for example, via a disconnect system such as disconnect system 100, to initiate, trigger, and/or otherwise execute an EDS, as described herein.

At 302, method 300 includes receiving, at a controller (e.g., control unit 130A and/or control unit 130B) and from a set of motion reference units (e.g., MRUs 140A-D), position data associated with a flexible joint that is disposed subsea between a drilling riser and a lower marine riser package (LMRP). At 304, method 300 includes determining, at the controller and based on the position data, an angular offset of the flexible joint. At 306, method 300 includes sending, from the controller and to a subsea control pod, a trigger signal in response to determining that the angular offset exceeds a predetermined threshold such that the subsea control pod initiates an emergency disconnect sequence (EDS).

References in the specification to "one embodiment," "an embodiment," "an example embodiment," "some embodiments," or the like, indicate that the embodiment(s) described may include one or more particular features, structures, or characteristics, but it shall be understood that such particular features, structures, or characteristics may or may not be common to each and every disclosed embodiment of the present disclosure herein. Moreover, such phrases do not necessarily refer to any one particular embodiment per se. As such, when one or more particular features, structures, or characteristics is described in connection with an embodiment or embodiments, as the case may be, it is submitted that it is within the knowledge of those skilled in the art to affect such one or more features, structures, or characteristics in connection with other one or more embodiments, where applicable or when such embodiments are not exclusive, whether or not explicitly described.

Detailed embodiments of the present disclosure are disclosed herein for purposes of describing and illustrating claimed structures and methods that may be embodied in various forms, and are not intended to be exhaustive in any way, or limited to the disclosed embodiments. Many modifications and variations will be apparent without departing from the scope of the disclosed embodiments. The terminology used herein was chosen to best explain the principles of the one or more embodiments, practical applications, or technical improvements over current technologies, or to enable understanding of the embodiments disclosed herein. As described, details of well-known features and techniques may be omitted to avoid unnecessarily obscuring the embodiments of the present disclosure.

As used in this specification, the singular forms "a," "an" and "the" include plural referents unless the context clearly dictates otherwise. Thus, for example, the term "a device" is intended to mean a single device or a combination of devices, "a network" is intended to mean one or more networks, or a combination thereof.

As used herein, the terms "about" and "approximately" generally mean plus or minus 10% of the value stated. For example, about 0.5 would include 0.45 and 0.55, about 10 would include 9 to 11, about 1000 would include 900 to 1100, etc.

As used herein, the term "tension" is related to the internal forces (i.e., stress) within an object in response to an external force pulling the object in an axial direction. For example, an object with a mass being hung from a rope at one end and fixedly attached to a support at the other end exerts a force to place the rope in tension. The stress within an object in tension can be characterized in terms of the cross-sectional area of the object. For example, less stress is applied to an object having a cross-sectional area greater than another object having a smaller cross-sectional area. The maximum stress exerted on an object in tension prior to plastic deformation (e.g., permanent deformation such as, for example, necking and/or the like) is characterized by the object's tensile strength. The tensile strength is an intensive property of (i.e., is intrinsic to) the constituent material. Thus, the maximum amount of stress of an object in tension can be increased or decreased by forming the object from a material with a greater tensile strength or lesser tensile strength, respectively.

While the embodiments have been particularly shown and described, it will be understood that various changes in form and details may be made. Although various embodiments have been described as having particular features and/or combinations of components, other embodiments are possible having a combination of any features and/or components from any of embodiments as discussed above. For example, where schematics and/or embodiments described above indicate certain components arranged in certain orientations or positions, the arrangement of components may be modified.

Where methods and/or events described above indicate certain events and/or procedures occurring in certain order, the ordering of certain events and/or procedures may be modified. Additionally, certain events and/or procedures may be performed concurrently in a parallel process when possible, as well as performed sequentially as described above. Moreover, the specific configurations of the various components can also be varied. For example, the size and specific shape of the various components can be different from the embodiments shown, while still providing the functions as described herein. More specifically, the size and shape of the various components can be specifically selected for a desired or intended usage. Thus, it should be understood that the size, shape, and/or arrangement of the embodiments and/or components thereof can be adapted for a given use unless the context explicitly states otherwise.

While some embodiments and/or implementations have been described and illustrated herein, a variety of other means and/or structures for performing the function and/or obtaining the results and/or one or more of the advantages is possible. More generally, parameters, dimensions, materials, and configurations described herein are meant to be exemplary and that the actual parameters, dimensions, materials, and/or configurations will depend upon the specific application or applications for which the inventive teachings is/are used. It is, therefore, to be understood that the foregoing embodiments are presented by way of example only and that, within the scope of the appended claims and equivalents thereto; and that embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

What is claimed is:

1. A disconnection system configured to initiate an emergency disconnect sequence (EDS), the disconnection system comprising:

a first controller including a first processor and a first memory operably coupled to the first processor; and a second controller including as second processor and a second memory operably coupled to the second processor, the first controller configured to:

receive, from a set of motion reference units operably coupled to a flexible joint, first position data generated by the set of motion references units and associated with the flexible joint when the flexible joint is operably coupled to and disposed between a drilling riser and a lower marine riser package (LMRP);

receive, from the set of motion reference units, second position data generated by the set of motion reference units and associated with the flexible joint when the flexible joint is operably coupled to and disposed between the drilling riser and the LMRP;

compare the second position data with the first position data to detect a sufficient degree of consistency between the second position data and the first position data;

determine, based on at least one of the first position data or the second position data, an angular offset of the flexible joint;

send, to a first subsea control pod disposed at or adjacent to the LMRP, a trigger signal in response to determining that the angular offset exceeds a predetermined threshold, such that the subsea control pod initiates the EDS; and send, to a second subsea control pod disposed at or adjacent to the LMRP, a signal representative of or based on the detection of the sufficient degree of consistency between the second position data and the first position data.

2. The disconnection system of claim 1, wherein the first position data includes data corresponding to a measure of one or more of a position, velocity, or acceleration of the flexible joint.

3. The disconnection system of claim 1, wherein the predetermined threshold includes a critical release angle.

4. The disconnection system of claim 1, wherein the first controller is collocated with a power distribution unit configured to supply power to the set of motion reference units.

5. The disconnection system of claim 1, wherein at least one motion reference unit from the set of motion reference units is disposed on a surface of a receiver plate or a receptor plate.

6. The disconnection system of claim 1, wherein the first controller is configured to send the trigger signal automatically without user-intervention.

7. The disconnection system of claim 1, wherein the predetermined threshold is dynamically defined in real-time during a drilling operation.

8. The disconnection system of claim 1, further comprising:

a set of load cells, a blow-out preventer (BOP) motion reference unit, and a linear variable differential sensor, all of which are operably coupled to at least one of the first controller or the second controller, at least one of the first controller or the second controller further configured to monitor fatigue of a wellhead coupled to the LMRP based on data generated by the set of load cells, the BOP motion reference unit, and the linear variable differential sensor.

9. A method, comprising:

receiving, at a first controller and from a set of motion reference units, first position data associated with a flexible joint that is disposed subsea between a drilling riser and a lower marine riser package (LMRP);

receiving, at a second controller and from the set of motion reference units, second position data generated by the set of motion reference units and associated with the flexible joint when the flexible joint is operably coupled to and dispose between the drilling riser and the LMRP;

determining, at the first controller and based on the first position data, an angular offset of the flexible joint;

sending, from the first controller and to a first subsea control pod, a trigger signal in response to determining that the angular offset exceeds a predetermined threshold such that the subsea control pod initiates an emergency disconnect sequence (EDS);

comparing the second position data with the first position data to detect a sufficient degree of consistency between the second position data and the first position data; and sending, to a second subsea control pod disposed at or adjacent to the LMRP, a signal representative of or based on the detection of the sufficient degree of consistency between the second position data and the first position data.

10. The method of claim 9, wherein the position data includes data corresponding to a measure of one or more of a position, velocity, of acceleration of the flexible joint.

11. The method of claim 9, wherein the predetermined threshold includes a critical release angle.

12. A non-transitory processor-readable medium storing code representing instructions to be executed by a processor, the code comprising code to cause the processor to:

receive, from a set of motion reference units operably coupled to a flexible joint, position data generated by the set of motion references units and associated with the flexible joint when the flexible joint is operably coupled to and disposed between a drilling riser and a lower marine riser package (LMRP);

determine, based on the position data, an angular offset of the flexible joint; and send, to a subsea control pod disposed at or adjacent to the LMRP, a trigger signal in response to determining that the angular offset exceeds a predetermined threshold, such that the subsea control pod initiates the EDS receive data generated by a set of load cells, a blow-out preventer (BOP) motion reference unit, and a linear variable differential sensor; and monitor fatigue of a wellhead coupled to the LMRP based on the data.

13. The non-transitory processor-readable medium of claim 12, wherein the position data includes data corresponding to a measure of one or more of a position, velocity, or acceleration of the flexible joint.

14. The non-transitory processor-readable medium of claim 12, wherein the predetermined threshold includes a critical release angle.

15. A disconnection system configured to initiate an emergency disconnect sequence (EDS), the disconnection system comprising:

a controller including a processor and a memory operably coupled to the processor;

a set of load cells;

a blow-out preventer (BOP) motion reference unit; and a linear variable differential sensor, the load cells, BOP motion reference unit, and linear variable differential sensor all operably coupled to the controller, the controller configured to:

receive, from a set of motion reference units operably coupled to a flexible joint, position data generated by the set of motion references units and associated with the flexible joint when the flexible joint is operably coupled to and disposed between a drilling riser and a lower marine riser package (LMRP);

determine, based on the position data, an angular offset of the flexible joint;

send, to a subsea control pod disposed at or adjacent to the LMRP, a trigger signal in response to determining that the angular offset exceeds a predetermined threshold, such that the subsea control pod initiates the EDS; and monitor fatigue of a wellhead coupled to the LMRP based on data generated by the set of load cells, the BOP motion reference unit, and the linear variable differential sensor.

16. The disconnection system of claim 15, wherein the position data includes data corresponding to a measure of one or more of a position, velocity, or acceleration of the flexible joint.

17. The disconnection system of claim 15, wherein the predetermined threshold includes a critical release angle.

18. The disconnection system of claim 15, wherein the controller is collocated with a power distribution unit configured to supply power to the set of motion reference units.

19. The disconnection system of claim 15, wherein at least one motion reference unit from the set of motion reference units is disposed on a surface of a receiver plate or a receptor plate.

20. The disconnection system of claim 15, wherein the controller is configured to send the trigger signal automatically without user-intervention.

21. The disconnection system of claim 15, wherein the predetermined threshold is dynamically defined in real-time during a drilling operation.

* * * * *